US006688237B2

(12) United States Patent
Bäck et al.

(10) Patent No.: US 6,688,237 B2
(45) Date of Patent: Feb. 10, 2004

(54) DEFORMATION ELEMENT

(75) Inventors: Gunter Bäck, Graz (AT); Werner Gödl, Wundschuh (AT); Johann P. Schmid, Stubenberg (AT); Ewald Brückler, Graz (AT); Christian Fellner, Graz (AT); Roman Brossschädl, Feldirchen (AT)

(73) Assignee: Siemens SGP Verkehrstechnik GmbH, Vienna (AT)

( * ) Notice: Subject to any disclaimer, the term of this patent is extended or adjusted under 35 U.S.C. 154(b) by 0 days.

(21) Appl. No.: 10/223,501

(22) Filed: Aug. 19, 2002

(65) Prior Publication Data

US 2003/0019390 A1 Jan. 30, 2003

Related U.S. Application Data

(63) Continuation of application No. PCT/AT01/00040, filed on Feb. 19, 2001.

(30) Foreign Application Priority Data

Feb. 18, 2000 (AT) ..... 250/00

(51) Int. Cl.[7] ..... B61D 15/06

(52) U.S. Cl. ..... 105/392.5; 105/410; 188/377; 293/110; 296/187.03

(58) Field of Search ..... 105/410, 396, 105/404, 409, 411, 392.5; 293/107, 110, 117, 120, 132, 133; 296/187.03; 188/371, 376, 377

(56) References Cited

U.S. PATENT DOCUMENTS 1,410,710 A * 3/1922 Murphy ..... 105/410
3,506,295 A * 4/1970 Yancey ..... 293/133
3,871,279 A * 3/1975 Allen ..... 105/410
3,888,531 A * 6/1975 Straza et al. ..... 293/120
3,983,962 A * 10/1976 Torke ..... 188/377
3,997,207 A * 12/1976 Norlin ..... 293/110
4,029,350 A * 6/1977 Goupy et al. ..... 293/110
4,165,113 A * 8/1979 Casse ..... 293/121
4,221,413 A * 9/1980 Bonnetain ..... 293/122
4,227,593 A * 10/1980 Bricmont et al. ..... 188/377
4,353,314 A * 10/1982 Miller et al. ..... 105/410
4,413,856 A * 11/1983 McMahan et al. ..... 296/188
5,114,198 A * 5/1992 Yamashita et al. ..... 293/120
5,507,540 A * 4/1996 Pernot ..... 293/102
5,660,116 A * 8/1997 Dannawi et al. ..... 105/392.5
5,715,757 A * 2/1998 Dannawi et al. ..... 105/392.5
6,196,135 B1 * 3/2001 Kashima et al. ..... 105/392.5
6,290,272 B1 * 9/2001 Braun ..... 293/120

* cited by examiner

*Primary Examiner*—S. Joseph Morano
*Assistant Examiner*—Lars A. Olson
(74) *Attorney, Agent, or Firm*—Thomas R. Vigil; Welsh & Katz, Ltd.

(57) ABSTRACT

The deformation element (1) of a rail-borne vehicle is disposed in the region of at least one deformation zone located on the end side of the vehicle and comprises at least one tubular hollow space, wherein a structure is attached in a replaceable manner in the rail-borne vehicle and is formed of two metal sheets (2*a*, 2*b*), of which at least one is designed as a profiled metal sheet (2*a'*, 2*b*') and which are connected together on mutually facing cross-pieces (3*a*, 3*b*) which lie against each other thus forming hollow boxes (4*a*, 4*b*) extending in parallel with respect to each other.

12 Claims, 3 Drawing Sheets

DEFORMATION ELEMENT

CROSS REFERENCE TO RELATED APPLICATIONS

This application is a continuation of PCT/AT01/00040 filed on Feb. 19, 2001 which claims priority from Austrian Application No. A 250/2000 filed on Feb. 18, 2000.

BACKGROUND OF THE INVENTION

1. Field of the Invention

The present invention relates to a deformation element of a rail-borne vehicle which is disposed in the region of at least one deformation zone located on the end side of the vehicle and comprises at least one tubular hollow space.

2. Description of the Prior Art

For financial reasons and reasons relating to safety technology, deformation zones are usually provided in the region of the ends located on the longitudinal side of a rail-borne vehicle. On the one hand, this serves to obviate or reduce any damage to the vehicle in the event of an accident, on the other hand vehicle passenger safety is thereby increased. The parts of a rail-borne vehicle which are most frequently directly involved in accidents are the front and rear carriage end region, since most accidents are rear end collisions—in the case of a train consisting of several coupled carriages individual carriages can collide together in an accident—or are head-on collisions involving other traffic participants or obstacles.

Therefore, in order to protect a rail-borne vehicle tubular deformation elements which can be compressed and folded in the event of a sufficiently strong force effect are integrated in the prior art into the front and mostly also into the rear vehicle face. This feature serves to use up some of the kinetic energy, which acts upon the vehicle, for the deformation of the deformation element. Reducing the kinetic energy in this way serves also to reduce the loading which acts upon the rest of the rail-borne vehicle.

By reason of the substantial intrinsic weight and the associated high kinetic energy of the rail-borne vehicle, it is still possible for extremely high peaks of force to occur during accidents. For this reason it is advantageous to introduce the respective loading into a deformation element at a low trigger force over the largest possible area and to distribute it over same.

Typically, the attempt is made to solve this problem in that mutually separately installed deformation elements, which are designed as straightforward tubular hollow bodies mostly having an approximately square cross-section, are integrated in parallel adjacent to each other into the vehicle face, wherein the longitudinal sides of the deformation elements are disposed in parallel with respect to the direction of travel. Conventionally, these deformation elements are affixed in the head regions of the vehicle underframe and are connected together by means of a transverse beam acting as a bumper. The entire vehicle's deformation characteristic to be achieved determines how many deformation elements are used and whether these deformation elements are installed at only one or both ends of a carriage.

U.S. Pat. Nos. 5,630,605 and 5,715,917 describe a method of reducing the energy released in the event of a collision by means of a impact-shock transmission element which is guided in such a manner as to be movable in a frame in the direction of travel, and a shock-absorbing honeycomb structure which can be compressed by means of the impact-shock transmission element.

FR 2 140 937 describes a front end region of a rail-borne vehicle which is disposed on both sides of a housing of an automatic coupling a corrugated metal sheet [sic]. This metal sheet is welded both to the coupling housing and also to the longitudinal and transverse beams of the rail-borne vehicle and forms a part of the vehicle structure, for which reason the replacement of this metal sheet in the event of a deformation is associated with substantial operational effort and financial cost.

EP 0 612 647 A1 discloses a railway carriage having a deformation element which is formed from a corrugated metal sheet and likewise forms a part of the vehicle structure, so that the replacement of the metal sheet is also associated in this case with substantial operational effort.

Furthermore, a disadvantage of the known devices is that by reason of the design undesirably high force peaks can nevertheless occur before the deformation elements fold. By virtue of these very high force peaks now and again, a large portion of the occurring loads can be transmitted to the passenger compartment. In order to prevent damage to the rail-borne vehicle or to prevent injury to vehicle passengers in the event an accident, the remaining vehicle structure must therefore be designed to be more robust and heavier, which has a detrimental effect upon the useful load. Furthermore, the relatively high costs in producing conventional deformation elements is disadvantageous. The replacement of damaged deformation elements is also associated with substantial operational effort.

BRIEF SUMMARY OF THE INVENTION

Therefore, it is an object of the invention to provide a deformation element which can be produced conveniently and cost-effectively and which has a low trigger force, wherein it is possible to introduce force over a large area and the said deformation element can also be replaced in a convenient manner.

This object is achieved in accordance with the invention by virtue of the fact that the deformation element is attached in a replaceable manner in the rail-borne vehicle and is formed from two metal sheets, of which at least one is designed as a profiled metal sheet, which are connected together on mutually facing cross-pieces which lie against each other thus forming hollow boxes extending in parallel with each respect to each other.

In the case of the deformation element in accordance with the invention, the metal sheets lying one on top of the other serve to form tubular hollow spaces which can be compressed in the event of an accident, wherein any damaged deformation elements can be replaced by new ones.

It is an object to provide a deformation element which renders it possible to cover and protect a larger width of the vehicle face continuously. In the event of an accident this feature substantially enables the force to be introduced into a deformation element according to the invention over a larger area than in the case of the known deformation elements, whereby the occurring force peak can be reduced substantially. A further significant advantage over the known deformation devices is evident the convenient and cost-effective manufacture.

In order to provide for the deformation element a holding device which guarantees ease of replacement, one advantageous embodiment relates to the metal sheets being held in a frame.

Connecting the two metal sheets in a tried and tested manner in practice ensures that the two metal sheets lying one on top of the other are welded together at points on their contact surfaces.

For reasons relating to cost and production, the method of welding the metal sheets at points is preferred over other possible connection methods, such as e.g. welding the two metal sheets by means of a fillet weld over their entire length or by means of a screw-connection.

In order to obtain the most effective possible deformation characteristics, the hollow boxes comprise a hexagonal cross-section.

In order to protect the largest possible area of the width of the vehicle and to allow the introduction of force over a large area into the deformation element, the metal sheets extend substantially over the entire width of the rail-borne vehicle.

In one advantageous embodiment of the invention, the frame comprises two side parts and a front part, wherein the front part has a box-shaped transverse beam which extends substantially over the entire width of the vehicle, wherein the side of the transverse beam remote from the rail-borne vehicle is provided with ribs, in order in the event of a collision with a second rail-borne vehicle to prevent the transverse beam of a rail-borne vehicle from sliding over the other and damaging unprotected regions of the vehicle.

One advantageous embodiment of attaching the beaded metal sheets in the frame is to weld the beaded metal sheets to the frame.

The assembly and removal of the deformation element is facilitated by virtue of the fact that the side parts of the frame can be inserted via guide rails into longitudinal beams of the rail-borne vehicle.

One embodiment of considerable practical use demonstrates that the side parts of the frame are releasably connected with the aid of clamping connections to the longitudinal beams of the rail-borne vehicle.

In one advantageous embodiment, the clamping connection can comprise four mutually displaceable wedges.

In an advantageous manner, two wedges are rigidly connected to a plate.

Furthermore, in the case of this embodiment, one wedge is rigidly connected to bars which each comprise a thread.

In order to fix the clamping connection, it is provided that a wedge can be attached to the rods via the threads by means of nuts.

BRIEF DESCRIPTION OF THE SEVERAL VIEWS OF THE DRAWINGS

The invention together with further advantages is explained in detail hereinunder with reference to one exemplified embodiment which is illustrated in the drawing, in which.

DETAILED DESCRIPTION OF THE INVENTION

Figure 1:
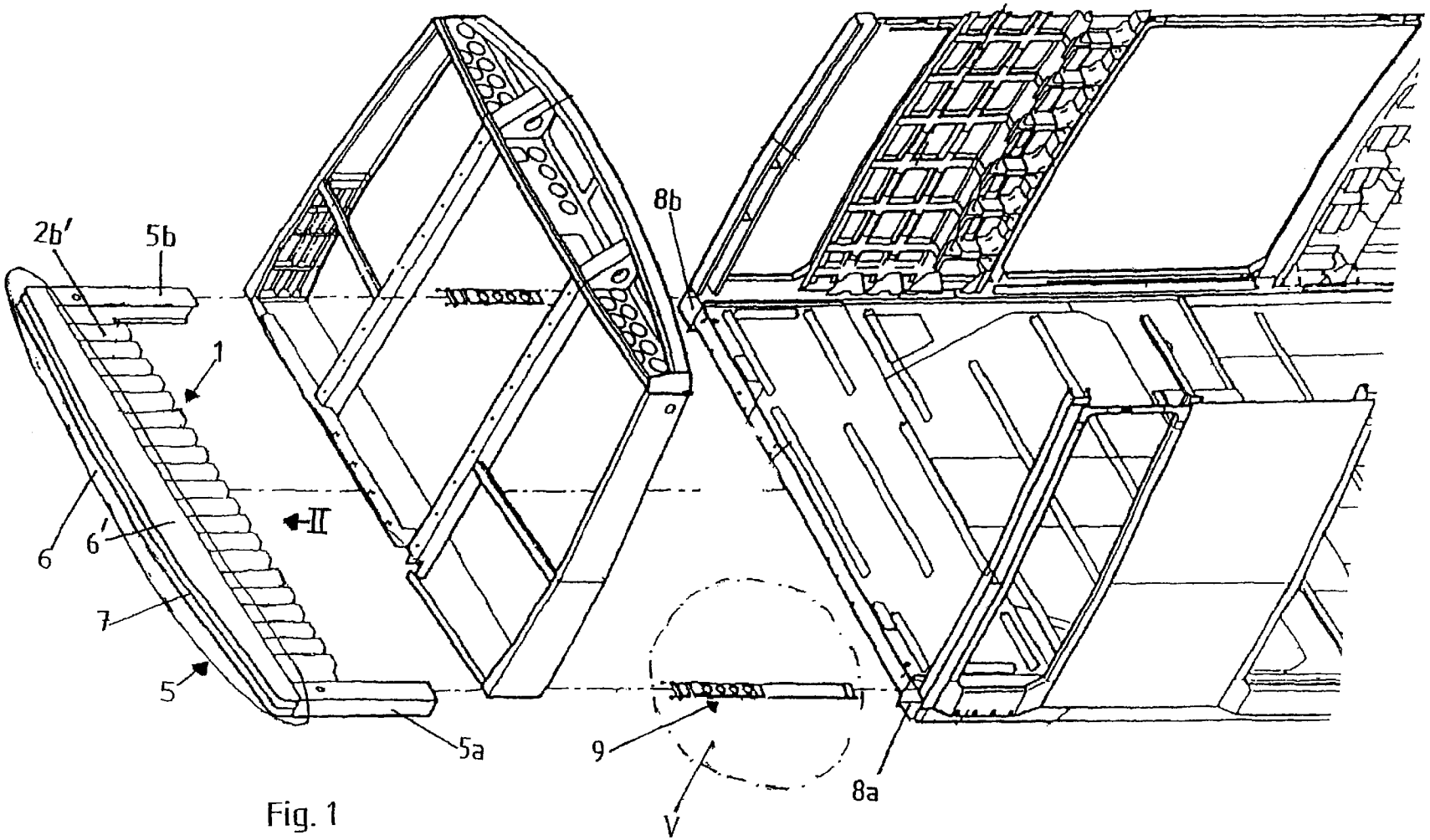
FIG. 1 shows a perspective view of portions of a rail-borne vehicle upper part having a deformation device in accordance with the invention.

As shown in FIG. 1, the upper part of a deformation element 1 in accordance with the invention comprises a profiled metal sheet 2*b*' having profiles provided periodically over the surface. The underside of the deformation element 1 is formed by means of a similar profiled metal sheet 2*a*' which, however, is not shown for illustrative reasons. The two similar profiled metal sheets 2*a*', 2*b*' lie one on top of the other in a mirror-inverted manner with respect to each other, wherein the contact surfaces of the two profiled metal sheets 2*a*', 2*b*' lie in the mirror plane. By virtue of this arrangement, hollow boxes 4*a* are formed with a hexagonal cross-section as described in greater detail hereinunder. This is shown particularly clearly in FIG. 2. The mutually facing cross-pieces 3*a*, 3*b* which lie against each other are mutually connected, preferably welded at points.

The two profiled metal sheets 2*a*', 2*b*' are connected, preferably welded, to a frame 5 which comprises two side parts 5*a*, 5*b* and a front part 6. The front part 6 consists of a transverse beam 6' which is designed as a welded box. On its side remote from the rail-borne vehicle, the transverse beam comprises ribs 7 which extend perpendicularly with respect to the carriage middle plane on the longitudinal side. In the event of a collision between two rail-borne vehicles, the ribs 7 on the front part 6 acting as a bumper prevent the front part 6 of the frame 5 of a rail-borne vehicle from "climbing over" the front part of the other rail-borne vehicle and damaging unprotected regions of the vehicle face.

For the embodiment illustrated in this case, the materials preferred for the profiled metal sheets 2*a*', 2*b*' and for the frame 5 are stainless steel and a low alloy steel respectively. However, it is certainly also feasible to use other materials, such as e.g. aluminium, for the profiled metal sheets 2*a*', 2*b*' and for the frame 5.

The side parts 5*a*, 5*b* of the frame 5 can be inserted into longitudinal beams 8*a*, 8*b* of the rail-borne vehicle by way of guide rails and can be fixed at this site by means of releasable clamping connections 9. In the event of damage caused to the deformation element 1, the clamping connections 9, which are described in detail hereinunder, are released and the deformation element 1 together with the frame 5 is replaced as a whole.

Figure 2:
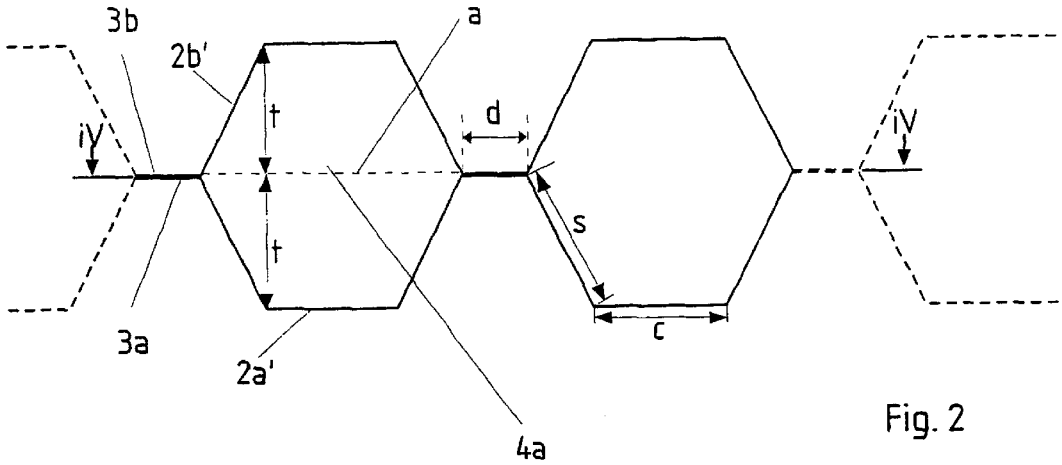
FIG. 2 shows a view of the deformation element in accordance with the invention from the direction II in FIG. 1.
Figure 3:
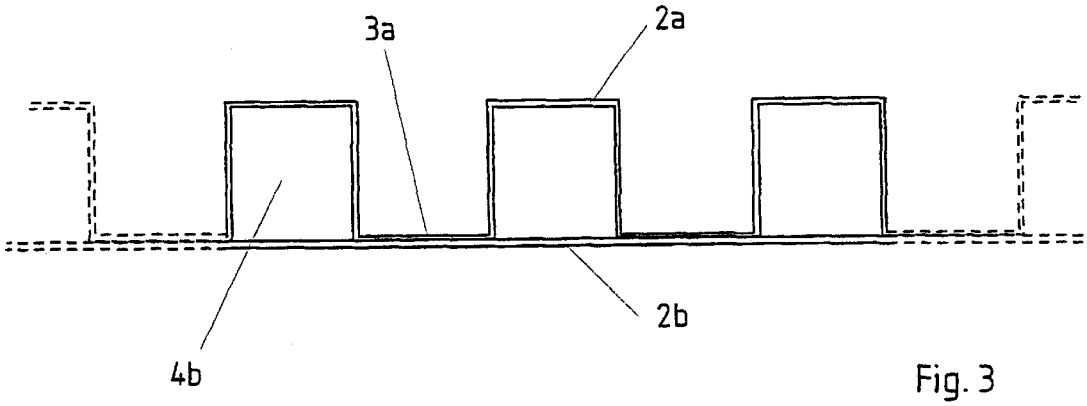
FIG. 3 shows a view of one embodiment of the deformation element in accordance with the invention from the direction II in FIG. 1.

In accordance with one preferred embodiment, as illustrated in FIG. 2, the profiled metal sheets 2*a*', 2*b*' are formed in cross-section as isosceles trapeziums, of which the longer parallel side a is open, wherein the two profiled metal sheets 2*a*', 2*b*' lie one on top of the other such that hollow boxes 4*a* are formed having the cross-section of a regular hexagon. The side length s, c of one of these regular hexagons is in the range between 40 and 100 mm. Virtually every symmetrical cross-sectional shape of the hollow boxes which forms a polygon—circle, triangle, rectangle, hexagon—is suitable in principle for a deformation element in accordance with the invention. If a rectangular or square cross-section is selected, then it is also possible to provide a smooth metal sheet instead of the second profiled metal sheet, as illustrated in FIG. 3. However, an embodiment having a hexagonal cross-section of the hollow boxes is preferred for production reasons.

In one embodiment of the invention as shown in FIG. 3, a profiled metal sheet 2*a* and a smooth metal sheet 2*b* are arranged one on top of the other such that hollow boxes 4*b* having a substantially square cross-sectional area are formed. One advantage of this embodiment is that it can be produced in a convenient and cost-effective manner.

Figure 4:
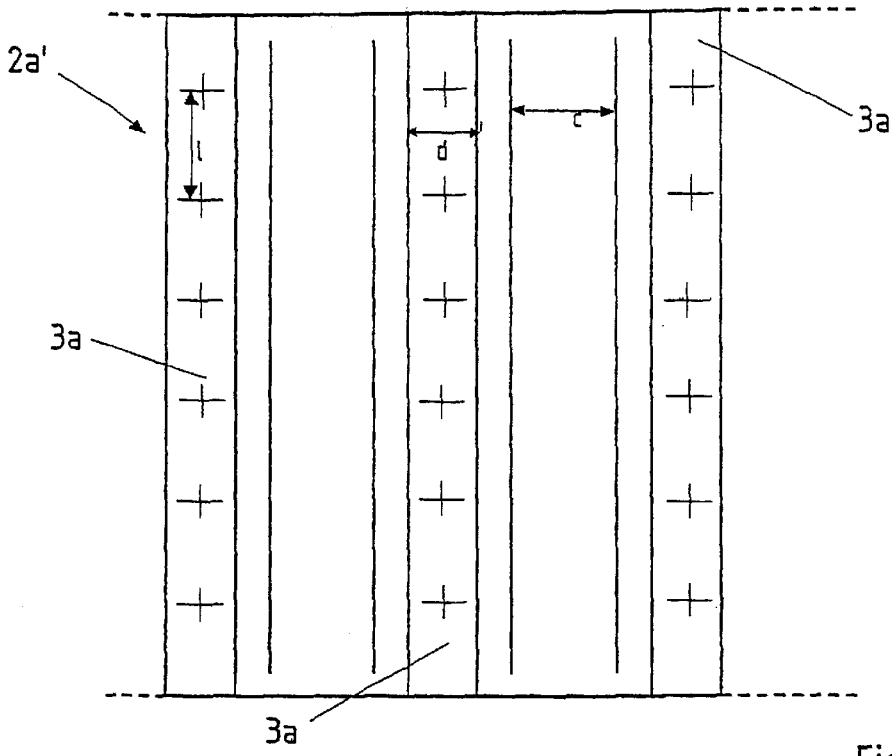
FIG. 4 shows a cross-section taken along line III—III in FIG. 2.

The deformation element in accordance with the invention as shown in FIG. 4 comprises a first profiled metal sheet 2*a*' on which is attached in a mirror-inverted manner a similar second profiled metal sheet 2*b*' which is not shown in this case for illustrative reasons, wherein the profiled metal sheets 2*a*', 2*b*' are welded together on their cross-pieces (3*a*, 3*b*) at points at a spacing 1 of about 20 mm.

The welding points are illustrated in the FIG. as crosses. In principle, it is also possible to use other types of connection between the profiled metal sheets 2*a*', 2*b*', e.g. a continuous weld seam or a screw-connection.

Figure 5:
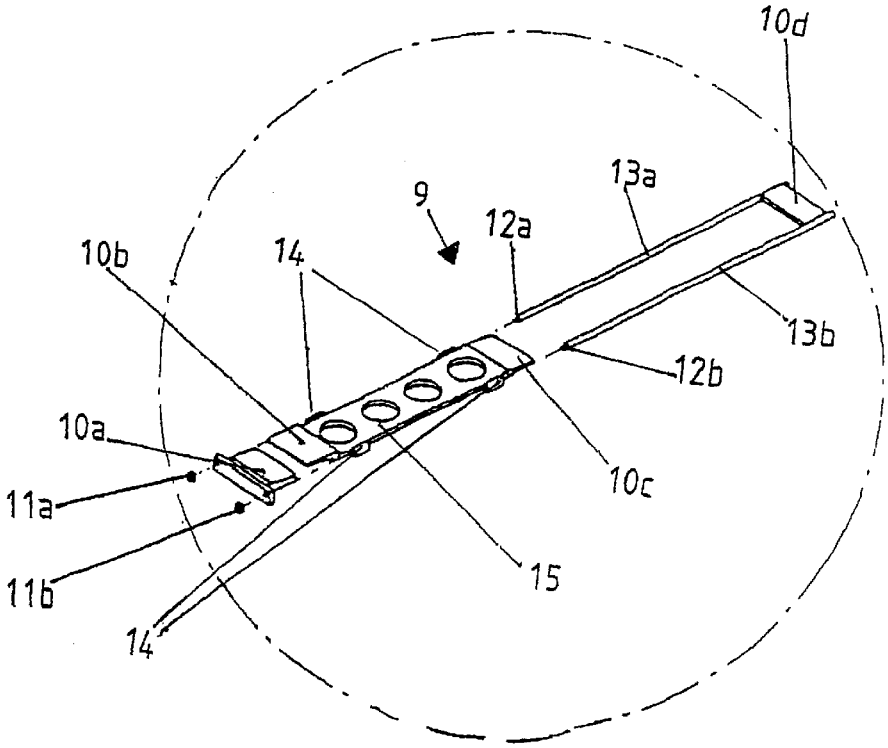
FIG. 5 shows the region V of FIG. 1.

The clamping connection 9 illustrated in FIG. 5 comprises two nuts 11*a*, 11*b* which can be tightened on end-side threads 12*a*, 12*b* of two rods 13*a*, 13*b*, and four screw wedges 10*a*, 10*b*, 10*c*, 10*d* which can be mutually displaced in pairs. The two rods 13*a*, 13*b* are mounted in a longitudinally displaceable manner in guides 14 which are disposed laterally on a plate 15. For weight-reducing reasons, the plate 15 comprises circular recesses 16. The clamping connections 9 are inserted into the side parts 5*a*, 5*b* of the frame 4 and into the longitudinal beams 8*a*, 8*b*. By tightening the two nuts 11*a*, 11*b*, the wedges 10*a*, 10*b*, 10*c*, 10*d* are each pushed in pairs over each other, whereby the corresponding side part 5*a*, 5*b* of the frame 4 can be fixed in the respective longitudinal beam 8*a*, 8*b* of the rail-borne vehicle.

We claim:

1. Deformation element (1) of a rail-borne vehicle which is disposed in the region of at least one deformation zone located on the front or rear end of the vehicle and comprises at least one hollow body having a tubular hollow space, characterised in that said hollow body is attached in a replaceable manner in the rail-born vehicle and is formed from two metal sheets (2*a*, 2*b*), of which at least one sheet is designed as a profiled metal sheet (2*a*', 2*b*') and which are connected together on mutually facing cross-pieces (3*a*, 3*b*) which lie against each other thus forming hollow boxes (4*a*, 4*b*) extending in parallel with respect to each other, wherein the metal sheets (2*a*, 2*b*) are held in a frame (5) comprising two side parts (5*a*, 5*b*) and a front part (6), and wherein the front part (6) comprises a box-shaped transverse beam (6') which extends substantially over the entire width of the vehicle.

2. Deformation element as claimed in claim 1 characterised in that the two metal sheets (2*a*, 2*b*) lying one on top of the other are welded together at points on their mutually contacting surfaces.

3. Deformation element as claimed in claim 1, characterised in that the hollow boxes (4*a*, 4*b*) comprise a hexagonal cross-section.

4. Deformation element as claimed in claim 1, characterised in that the metal sheets (2*a*, 2*b*) extend substantially over the entire width of the rail born vehicle.

5. Deformation element as claimed in claim 1, characterised in that the side of the transverse beam (6') remote from the rail-born vehicle is provided with ribs (7).

6. Deformation element as claimed in claim 1, characterised in that the metal sheets (2*a*, 2*b*) are welded to the frame (5).

7. Deformation element as claimed in claim 1, characterised in that the side parts (5*a*, 5*b*) of the frame (5) are inserted via guide rails into longitudinal beams (8*a*, 8*b*) of the rail-borne vehicle.

8. Deformation element as claimed in claim 7, characterised in that the side parts (5*a*, 5*b*) of the frame (5) are connected by means of releasable clamping connections (9) to the longitudinal beams (8*a*, 8*b*) of the rail-borne vehicle.

9. Deformation element as claimed in claim 8, characterised in that the clamping connection comprises four mutually displaceable wedges (10*a*, 10*b*, 10*c*, 10*d*).

10. Deformation element as claimed in claim 9, characterised in that two wedges (10*b*, 10*c*) are rigidly connected to a plate (15).

11. Deformation element as claimed in claim 10, characterised in that a wedge (10*d*) is rigidly connected to rods (13*a*, 13*b*) which each comprise a thread (12*a*, 12*b*).

12. Deformation element as claimed in claim 11 characterised in that a wedge (10*a*) is attached to the rods (13*a*, 13*b*) via threads (12*a*, 12*b*) by means of nuts (11*a*, 11*b*).

* * * * *